US006234095B1

(12) United States Patent
Smith et al.

(10) Patent No.: US 6,234,095 B1
(45) Date of Patent: May 22, 2001

(54) YARN FEED ATTACHMENTS FOR TUFTING MACHINES

(75) Inventors: Edward Huel Smith, Cisco; Charles Wayne Williams, Dalton, both of GA (US)

(73) Assignee: Honesty Enterprises, Inc., Dalton, GA (US)

( * ) Notice: Subject to any disclaimer, the term of this patent is extended or adjusted under 35 U.S.C. 154(b) by 0 days.

(21) Appl. No.: 09/636,143

(22) Filed: Aug. 10, 2000

(51) Int. Cl.[7] ..... D05C 15/22
(52) U.S. Cl. ..... 112/80.73
(58) Field of Search ..... 112/80.73, 80.7, 112/284, 220

(56) References Cited

U.S. PATENT DOCUMENTS 2,876,441 * 3/1959 Boyles ..... 112/80.73
2,954,865 * 10/1960 Hackney et al. ..... 112/80.73 X
3,224,395 * 12/1965 Card ..... 112/80.73
3,906,876 * 9/1975 Fitton ..... 112/80.73
5,806,446 * 9/1998 Morrison et al. ..... 112/80.73

* cited by examiner

*Primary Examiner*—Ismael Izaguirre
(74) *Attorney, Agent, or Firm*—Alan Ruderman; Miller & Martin LLP

(57) ABSTRACT

A tufting machine having a yarn feed roll attachment wherein the rolls are driven by a chain drive and having an adjustable tension applying device including a housing having a yoke defined by two arms separated by a slot. The arms of the yoke include planar interior surfaces which cooperate with a planar support plate and at least one connector which locates the housing of the device in a fixed position relative to the support plate. At a second end of the housing is a guide which preferably rotates about a guide axis. The guide axis is preferably perpendicular to the plane of the support plate, when installed.

18 Claims, 3 Drawing Sheets

YARN FEED ATTACHMENTS FOR TUFTING MACHINES

BACKGROUND OF THE INVENTION

1. Field of the Invention

The present invention relates to chain tension adjustment devices for use with chain driven rolls of yarn feed attachments for tufting machines.

2. Description of Related Art

Yarn feed attachments for tufting machines are made by a number of manufacturers. One such attachment is described in detail in U.S. Pat. No. 4,688,497. These attachments may be connected to a tufting machine by a horizontally disposed support frame as in the aforesaid patent. The support frame carries a plurality of transversely extending parallel drive shafts. The shafts are driven at different speeds, but are generally in synchronization with the reciprocation of the needles. Some shafts are driven at relatively high speeds while others are driven at relatively slow speeds. The frame usually includes a plurality of parallel longitudinally extending, vertically disposed support plates which support the drive shafts.

Disposed below the main frame are a plurality of pairs of yarn feed rolls, each pair being carried by a roll shaft journalled by a roll shaft support bracket secured to the frame. The roll shafts are also usually supported by the support plates of the frame. Each pair of the rolls are typically located on opposite sides of each support plate and are mounted at the ends of the roll shaft. On the ends of each shaft and within each roll is an electric clutch, the rolls being selectively engaged and disengaged from the common roll shaft by actuation of the individual clutch for that roll. Each roll shaft is driven from one of the drive shafts by one or more chains. Typically each roll has a roughened periphery so as to be capable of driving one or a plurality of yarns at the peripheral speed of the roll.

When chains are installed on the yarn feed attachment to connect the drive shafts to the rolls, they sometimes do not provide an optimum amount of tension required to properly operate the rolls. If the chains are too loose, they may come off or fail to properly drive the rolls which may result in broken yarn fed to the tufting machine causing the machine to be shut down, the yarn ends tied, and production resumed. Furthermore, if the chains are too tight, they may break causing the roll to stop and the yarn to break and another stoppage of the tufting machine.

Accordingly, a need exists to provide a chain tension adjustment device for a yarn feed attachment to provide a desired amount of tension to the chain to maintain the tufting machine in operation.

BRIEF SUMMARY OF THE INVENTION

An adjustable tension device for use with yarn feed attachments allows an operator to set the tension on a particular chain proceeding from the drive shaft to the roll shaft. The tension device includes a housing having a yoke and a connector. The opening between the arms of the yoke receives a support plate of the frame. Since the support plates of most tufting machines are planar members having a substantially constant and relatively narrow width, the opening between the arms of the yoke is configured to allow the yoke arms to extend along opposing sides of the petition. At least one connector, such as a set screw, is utilized to maintain the yoke in a fixed relationship relative to the petition.

Extending from the housing is a rotatable guide or roller. The guide contacts the chain with the yoke placed over the support plate. When placed in the desired position relative to the support plate and chain, the yoke is secured to the support plate with at least one connector.

BRIEF DESCRIPTION OF SEVERAL VIEWS OF THE DRAWINGS

Advantages of the invention as well as other objects will become apparent from the following description taken in connection with the accompanying drawings in which.

DETAILED DESCRIPTION OF THE PREFERRED EMBODIMENT

Figure 1:
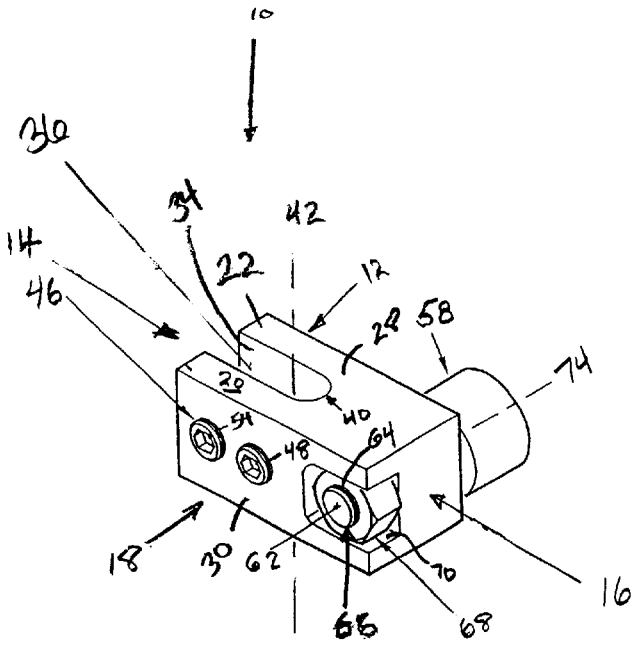
FIG. 1 is an elevational view of the preferred embodiment of the yarn feed roll chain drive adjustable tension device.
Figure 2:
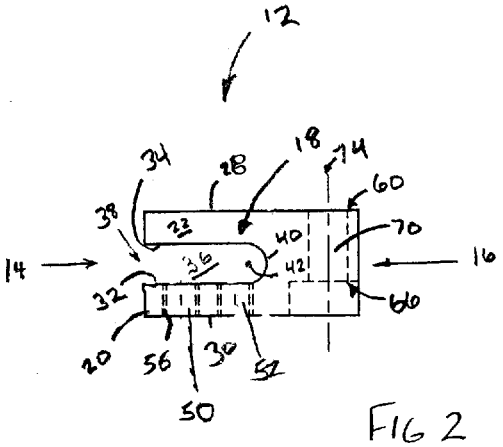
FIG. 2 is a side plan view of the device housing of FIG. 1 with interior portions shown in phantom.
Figure 3:
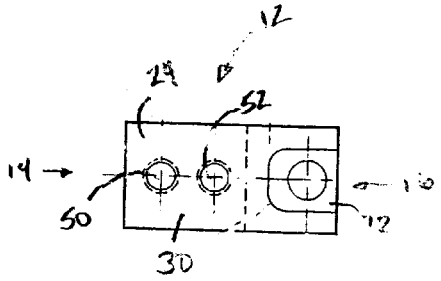
FIG. 3 is a back plan view of the device housing of FIG. 2 with interior portions shown in phantom.
Figure 4:
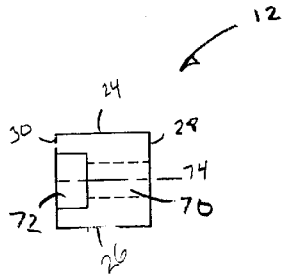
FIG. 4 is a top plan view of the device housing of FIG. 2.

FIGS. 1–4 illustrate the preferred embodiment of the adjustable tension applying apparatus for use with yarn feed attachments supplying tufting machines. The device 10 has a housing 12 with first and second ends 14, 16. A yoke 18 is located at the first end 12 and is defined by two arms, first and second arms 20, 22. The arms 20, 22 preferably have a planar side surfaces 24, 26 and planar front and back surfaces 28, 30. Interior surfaces 32, 34 are also preferably planar.

The interior surfaces 32, 34 define a slot 36 there between with a free end 38 and a confining end 40. The confining end 40 illustrated has a semicircular cross section with a slot axis 42 extending along the center of the semi-circular cross section. The slot axis 42 extends along a support plate 44 (illustrated in FIGS. 5–7) when installed.

Figure 5:
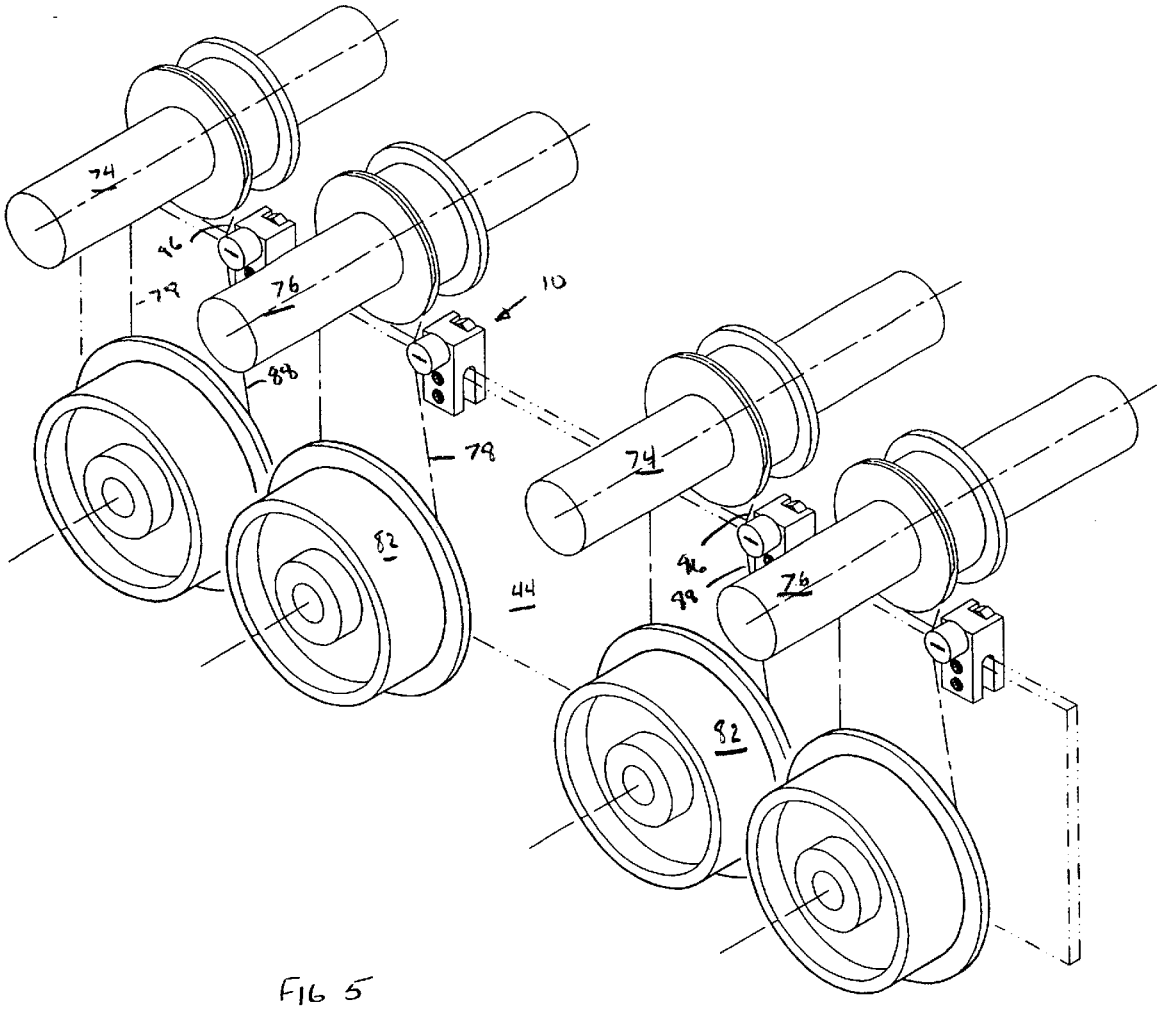
FIG. 5 is a top perspective view of a plurality of alternating preferred devices installed on a support plate of a yarn feed attachment.
Figure 6:
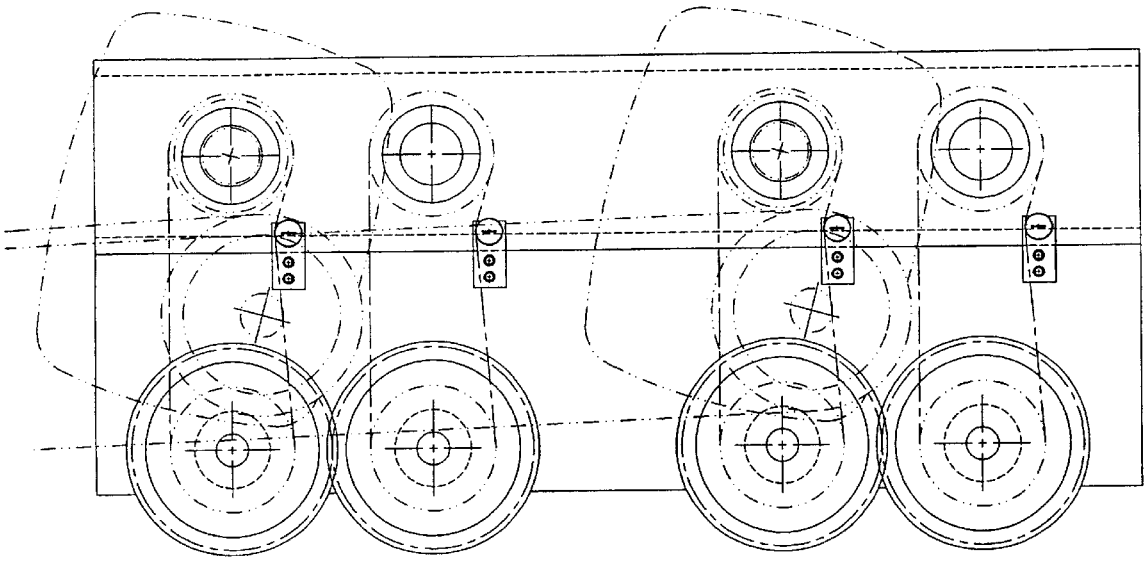
FIG. 6 is an side plan view of a portion of a yarn feed attachment with a plurality of the alternating preferred devices installed with portions of the yarn feed attachment shown in phantom.
Figure 7:
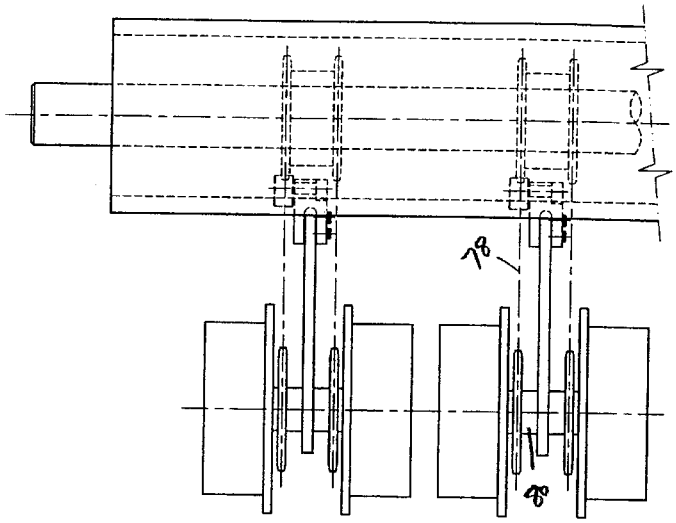
FIG. 7 is a back plan view of a portion of a yarn feed attachment with a plurality of the devices installed with portions of the yarn feed attachment shown in phantom.

Referring back to FIGS. 1–4, along the first arm 20 are first and second connectors 46, 48 are located along first arm 20. First and second connectors 46, 48 are illustrated as set screws with a socket head. The connectors 46, 48 extend through first and second bores 50, 52. Cooperating threads 54, 56 allow the connectors 46, 48 to move relative to the housing 12 upon rotation of the connectors 46, 48. Upon rotating the connectors 46, 48 a sufficient amount, the connectors 46, 48 will protrude beyond the interior surface 32 of the first arm 20 to contact the support plate 44 (as shown in FIGS. 5–7). The connectors 46, 48 connect the housing 12 to the plate 44 to prevent the housing 12 from moving relative to the plate 44. Third and fourth connectors 47, 49 may also be utilized as illustrated in FIGS. 5 and 6 with the second arm 22 in an alternatively preferred embodiment. Other connectors including a friction fit, welding, adhesives or others may also be utilized to connect the housing 12 to the plate 44.

FIGS. 1–4 also illustrate a second end 16 of the housing 12 connected to a guide 58. The guide 58 illustrated, has a roller, or cam follower with a bearing mounted to a first end 60 of post 62. The post 62 has threads 64 at second end 66. The threads 64 cooperate with nut 68 to secure the guide 58 to the housing 12. When installed, the post 62 extends through passage 70 into notch 72. The nut 68 secures the post 62 at the notch 72. The notch 72 is a recessed area beginning at the top of the housing 12 and extending a distance along the side 24 of the housing 12 at a depth. The distance and the depth of the notch 72 are sufficient to accommodate the nut 68.

The guide 58 is preferably disposed along a guide axis 74, the axis of rotation of the guide 74. The guide axis 58 is substantially perpendicular to the slot axis 42 which would extend along plate 44, when installed. The guide axis 58 is also perpendicular to the side 26 of the housing 12. In other embodiments, the guide 58 may be located at other angular relationships relative to the housing 12.

FIGS. 5–7 illustrate different portions of a yarn feed attachment which would be connected to an operational tufting machine. First and second drive shafts 74, 76 are connected by chains 78 to first and second roll shafts (the second roll shaft 80 is illustrated in FIG. 7, the first roll shaft is obscured from view in the Figures). The chains 78 illustrated operate in a plane substantially parallel to the support plates 44. Rolls 82 are connected to the roll shaft by electric clutches (obscured from view by the rolls 82).

A plurality of devices 10 are illustrated in FIGS. 5–7 applying tension to at least some of the chains 78. When a pair of chains 78 are utilized to drive a single roll shafts 80, only one device 10 is illustrated, although two or more could be utilized acting on one or both chains 78. The guide 58 contacts the chain 78 between the drive shafts 74, 76 and the roll shafts 80 in the chain operating plane. At the contact point 84, the chain 78 is deflected to form a first segment 86 and a second segment 88. The first and second segment 86, 88 are not colinear with one another.

For a given chain length under at least some tension, the greater the angle between the first and second segments 86,88, the greater the tension on the chain 78. A tension measuring device may evaluate the chain tension when adjusting the position of the guide 58 and device 10. With the guide 58 placed in the desired position relative to the chain 78, the first, second, third, and/or fourth connectors 46–49 may secure the housing 12 to the plate 44. The use of more than one connector 46–49 has been found helpful in reducing th tendency of the housing 12 to rotate about the connector 46, 47, 48, or 49, however, is not required for proper operation.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed herein is:

1. In a tufting machine having a yarn feed attachment including support plates and drive shafts for driving feed rolls by means of chains, an adjustable tension applying device comprising:

a housing with a yoke at a first end of the housing, the yoke defined by two arms having planar interior surfaces separated by a slot;

a connector adapted to secure said housing at the yoke to said support plate when installed; and a guide connected to the housing and configured to contact said chain when installed.

2. In a tufting machine as recited in claim 1 wherein the connector comprises a first set screw extending through a first bore in a first arm of the yoke.

3. In a tufting machine as recited in claim 2 wherein the connector further comprises a second set screw extending through a second bore in the first arm of the yoke.

4. In a tufting machine as recited in claim 1 wherein the guide rotates about a guide axis, the slot of the yoke defines a slot axis substantially parallel to the planar interior surface of one of the two arms, and the guide axis and support axis are substantially perpendicular.

5. In a tufting machine as recited in claim 1 wherein the guide extends laterally from a side portion of the housing.

6. In a tufting machine as recited in claim 5 wherein the guide extends substantially perpendicularly from the side portion of the housing.

7. In a tufting machine as recited in claim 1 wherein the guide is a roller connected to a bearing and a post, said post extending through a guide passage in said housing.

8. In a tufting machine as recited in claim 7 wherein the post includes a threaded portion, said threaded portion received within a nut securing said guide to said housing.

9. A yarn feed mechanism for a tufting machine of the type having needles which are reciprocated for inserting loops of yarns through successive portions of a back material fed through the tufting machine, the needles receiving the yarns from a source of yarns adjacent to the tufting machine, the needles being reciprocated in synchronization with the rotation of a main shaft on the machine, said yarn feed mechanism comprising:

(a) a support frame disposed adjacent to said tufting machine;

(b) a plurality of first feed rolls transversely spaced from each other for rotation about a common first axis;

(c) a plurality of second yarn feed rolls transversly spaced from each other for rotation about a second common axis;

(d) a plurality of first roll shafts supported by said frame and transversely spaced from each other for rotation about said first common axis;

(e) a plurality of second roll shafts supported by said frame and transversely spaced from each other along said second common axis;

(f) a plurality of longitudinally extending transversely spaced plates extending below said frames for supporting pairs of said first and second drive shafts;

(g) means for driving said first shafts at one speed of rotation and said second shafts at a different speed of rotation having a plurality of chain;

(h) clutch means mounted on the end portion of each first shaft and on the end portion of each second shaft, said rolls being respectively received over said clutch means, whereby the clutch means of each roll will engage and rotate its associated roll from its shaft with said chains when the clutch is engaged, and will permit its associated roll to rotate freely when that clutch means disengages its associated roll;

(i) the space between a first roll on one first shaft and an adjacent first roll on the next adjacent first shaft being essentially unobstructed for permitting intermediate portions of yarns between the source of yarns and the needles to be passed partially around said first rolls without unthreading or breaking the yarns;

(j) the space between a second roll on one second shaft and an adjacent second roll on the next adjacent second shaft being essentially unobstructed for permitting the intermediate portion of yarns passed partially around the first roll to also be passed partially around the second roll to provide support for a yarn or yarns on both a first roll and a second roll;

(k) at least one chain tensioning device, said device having a housing connected to one of said plates and a guide connected to the housing, said guide contacting at least one of said chains at a contact point between the shafts and the rolls wherein the contacted chain forms a first and a second segment at the contact point, the first and second segments non colinear with one another.

10. The yarn feed mechanism of claim 9 wherein the at least one chain tensioning further comprises a yoke connecting the housing to the plate.

11. The yarn feed mechanism of claim 10 further comprising a connector connecting the yoke to the plate.

12. The yarn feed mechanism of claim 11 wherein the connector is a set screw extending through a first bore in a first arm of the yoke.

13. The yarn feed mechanism of claim 9 wherein the guide is a roller connected to a bearing and a post, said post extending through a guide passage in said housing.

14. The yarn feed mechanism of claim 9 wherein the guide rotates about a guide axis, the yoke of the housing is defined by two arms about a slot, said slot having a slot axis, and the guide axis and slot axis are substantially perpendicular.

15. The yarn feed mechanism of claim 9 wherein the guide extends laterally from a side portion of the housing.

16. The yarn feed mechanism of claim 15 wherein the guide extends substantially perpendicularly from the side portion of the housing.

17. In a tufting machine yarn feed attachment having support plates and chains connecting drive shafts to roll shafts, an adjustable tension applying device comprising:

a housing with a yoke at a first end of the housing, the yoke defined by two arms having interior surfaces separated by a slot;

a connector adapted to secure said housing at the yoke to said support plate when installed; and a guide rotatable about a guide axis, said guide connected to a second end of the housing and configured to contact said chain when installed.

18. In a tufting machine as recited in claim 17 wherein the interior surfaces of the yoke are planar, and said guide axis is substantially perpendicular to said planar interior surfaces of said yoke.

* * * * *